United States Patent [19]

Ito

[11] Patent Number: 4,958,190

[45] Date of Patent: Sep. 18, 1990

[54] IMAGE FORMING APPARATUS

[75] Inventor: Masazumi Ito, Osaka, Japan

[73] Assignee: Minolta Camera Kabushiki Kaisha, Osaka, Japan

[21] Appl. No.: 423,698

[22] Filed: Oct. 18, 1989

Related U.S. Application Data

[63] Continuation of Ser. No. 243,821, Sep. 13, 1988, abandoned.

[30] Foreign Application Priority Data

Sep. 14, 1987 [JP] Japan ..... 62-230386

[51] Int. Cl.[5] ..... G03G 15/00

[52] U.S. Cl. ..... 355/228; 355/245; 355/326

[58] Field of Search ..... 355/228, 245, 246, 326, 355/328

[56] References Cited

U.S. PATENT DOCUMENTS

| | | | |
|---|---|---|---|
| 2,910,963 | 11/1959 | Herman . | |
| 3,572,288 | 8/1968 | Turner . | |
| 3,914,043 | 10/1975 | McVeigh . | |
| 3,926,518 | 12/1975 | Berry et al. | 355/228 |
| 3,960,445 | 6/1976 | Drawe . | |
| 3,967,891 | 7/1976 | Rippstein . | |
| 4,099,860 | 7/1978 | Connin . | |
| 4,153,364 | 5/1979 | Suzuki et al. | 355/228 X |
| 4,275,958 | 6/1981 | Tachika et al. . | |
| 4,336,994 | 6/1982 | Banton . | |
| 4,346,982 | 8/1982 | Nakajima et al. . | |
| 4,373,798 | 2/1983 | Tsukada et al. . | |
| 4,572,102 | 2/1986 | Yuge et al. . | |
| 4,579,443 | 4/1986 | Abuyama et al. . | |
| 4,587,568 | 5/1986 | Takayama et al. . | |
| 4,619,514 | 10/1986 | Ide . | |
| 4,627,707 | 12/1986 | Tani et al. . | |
| 4,634,259 | 1/1987 | Oishi et al. . | |
| 4,641,602 | 2/1987 | Kasai . | |
| 4,657,376 | 4/1987 | Ide . | |
| 4,659,211 | 4/1987 | Oka . | |
| 4,666,288 | 5/1987 | Watanabe . | |
| 4,668,978 | 5/1987 | Gokita . | |
| 4,685,794 | 8/1987 | Watanabe . | |
| 4,690,543 | 9/1987 | Watanabe . | |
| 4,710,016 | 12/1987 | Waatanabe . | |
| 4,720,730 | 1/1988 | Ito . | |
| 4,723,148 | 2/1988 | Hamakawa . | |
| 4,728,985 | 3/1988 | Nakashima et al. . | |
| 4,740,811 | 4/1988 | Watanabe . | |
| 4,743,945 | 5/1988 | Ito et al. . | |
| 4,743,946 | 5/1988 | Nishimori et al. . | |
| 4,745,437 | 5/1988 | Oka et al. . | |
| 4,746,954 | 5/1988 | Matuura et al. . | |
| 4,754,301 | 6/1988 | Kasamura et al. . | |
| 4,772,921 | 9/1988 | Ito . | |

FOREIGN PATENT DOCUMENTS

| | | |
|---|---|---|
| 48-22212 | 7/1973 | Japan . |
| 51-134635 | 11/1976 | Japan . |
| 54-30833 | 3/1979 | Japan . |
| 60-170868 | 9/1985 | Japan . |
| 60-194469 | 10/1985 | Japan . |
| 60-212778 | 10/1985 | Japan . |
| 61-72270 | 4/1986 | Japan . |
| 61-203474 | 9/1986 | Japan . |
| 62-61464 | 3/1987 | Japan . |
| 62-90186 | 6/1987 | Japan . |
| 62-59504 | 12/1987 | Japan . |

*Primary Examiner*—R. L. Moses

*Attorney, Agent, or Firm*—Burns, Doane, Swecker & Mathis

[57] ABSTRACT

An image forming apparatus comprising a drum having a photoconductive surface, (b) latent image forming means for irradiating the photoconductive surface with information carrying light of a variable intensity for forming latent images on the photoconductive surface, an image developing stage comprising at least two developing units of different types each for developing the latent images on the photoconductive surface into visible images, selecting means for selecting one of the developing units, and control means for regulating the intensity of the light depending on the developing unit selected by the selecting means.

16 Claims, 10 Drawing Sheets

A03

B01
SWITCH 220 ON
NO
YES
B02
IND. 220a ON
NO
B03
YES
OFF IND. 220a
B05
ON IND. 220a
B04
ON 5TH IND. 218
OFF 1ST-9TH IND. 218
B06
B07
DEC. SWITCH ON
NO
YES
B08
IND. 220a OFF
NO
YES
B09
DECREMENT EMAN
B10
EMAN LESS THAN 1ST DEG
NO
B11
YES
SET EMAN
B12
INC. SWITCH ON
NO
YES
B13
IND. 220a OFF
NO
YES
B14
INCREMENT EMAN
B15
EMAN MORE THAN 9TH DEG
NO
YES
B16
SET EMAN
B

IMAGE FORMING APPARATUS

This application is a continuation of application Ser. No. 243,821, filed Sept. 13, 1988, now abandoned.

FIELD OF THE INVENTION

The present invention relates to an image forming apparatus such as an image duplicating apparatus or a printer and, more particularly, to an image forming apparatus equipped with two or more developing units.

BACKGROUND OF THE INVENTION

An image duplicating apparatus is typical of an image forming apparatus of the nature to which the present invention generally appertains. An image forming apparatus of this type may be equipped with two or more developing units which are to be selectively put to use. These developing units have stocks of developer powders or agents of different natures such as different colors. For each cycle or a series of cycles of duplicating operation, any one of the developing units is selected for use to form images of, typically, different colors on a single or a plurality of print sheets.

In the meantime, it is known in the art that, in scanning a document sheet with a beam of light for duplicating the images thereon, it is preferable that the intensity of light be regulated depending on the nature of the developer agent to be used for the printing of the images reproduced. Thus, the user of a known image duplicating apparatus of the type using two or more developing units has been required to adjust the intensity of image scanning light depending on the nature of the developing agent stored in the selected developing unit. Laborious and time-taking steps must be taken by the operator of the apparatus for such adjustment of the intensity of light or, "exposure value" with which a document sheet is to be irradiated with a scanning beam of light. Such steps are liable to invite errors and may thus lead to failures of the apparatus or to reproduction of unwanted images from the original. These problems are frequently experienced in an image duplicating apparatus but will be also encounters in an image forming apparatus of another type or nature. The present invention contemplates elimination of such problems inherent in a prior-art image forming apparatus of the type using two or more developing units.

SUMMARY OF THE INVENTION

In accordance with one outstanding aspect of the present invention, there is provided an image forming apparatus comprising (a) means having a photoconductive surface, (b) latent image forming means for irradiating the photoconductive surface with information carrying light of a variable intensity for forming latent images on the photoconductive surface, (c) image developing means comprising at least two developing units of different types each for developing the latent images on the photoconductive surface into visible images, (d) selecting means for selecting one of the developing units, and (e) control means for regulating the intensity of the light depending on the developing unit selected by the selecting means.

In accordance with another outstanding aspect of the present invention, there is provided an image forming apparatus comprising (a) means having a photoconductive surface, (b) latent image forming means for irradiating the photoconductive surface with information carrying light of a variable intensity for forming latent images on the photoconductive surface, (c) image developing means of any of a plurality of types and detachable from the apparatus, the image developing means being operative to develop the latent images on the photoconductive surface into visible images, (d) detecting means for detecting the type of the developing means, and (e) control means for regulating the intensity of the light depending on the type of the developing means detected by the detecting means.

In accordance with still another outstanding aspect of the present invention, there is provided an image forming apparatus comprising (a) means having a photoconductive surface, (b) latent image forming means for irradiating the photoconductive surface with information carrying light of a variable intensity for forming latent images on the photoconductive surface, (c) image developing means comprising at least two developing units of different types each for developing the latent images on the photoconductive surface into visible images, (d) memory means storing a plurality of sets of data representative of different intensities, respectively, of the light with which the photoconductive surface is to be irradiated with the latent image forming means, each set of data being specific to the type of each of the developing units, (e) selecting means for selecting one of the developing units, and (f) control means for regulating the intensity of the light on the basis of the set of data specific to the type of the developing unit selected by the selecting means.

BRIEF DESCRIPTION OF THE DRAWINGS

The features and advantages of an image forming apparatus according to the present invention will be more clearly appreciated from the following description taken in conjunction with the accompanying drawings in which.

DESCRIPTION OF THE PREFERRED EMBODIMENT

Figure 1:
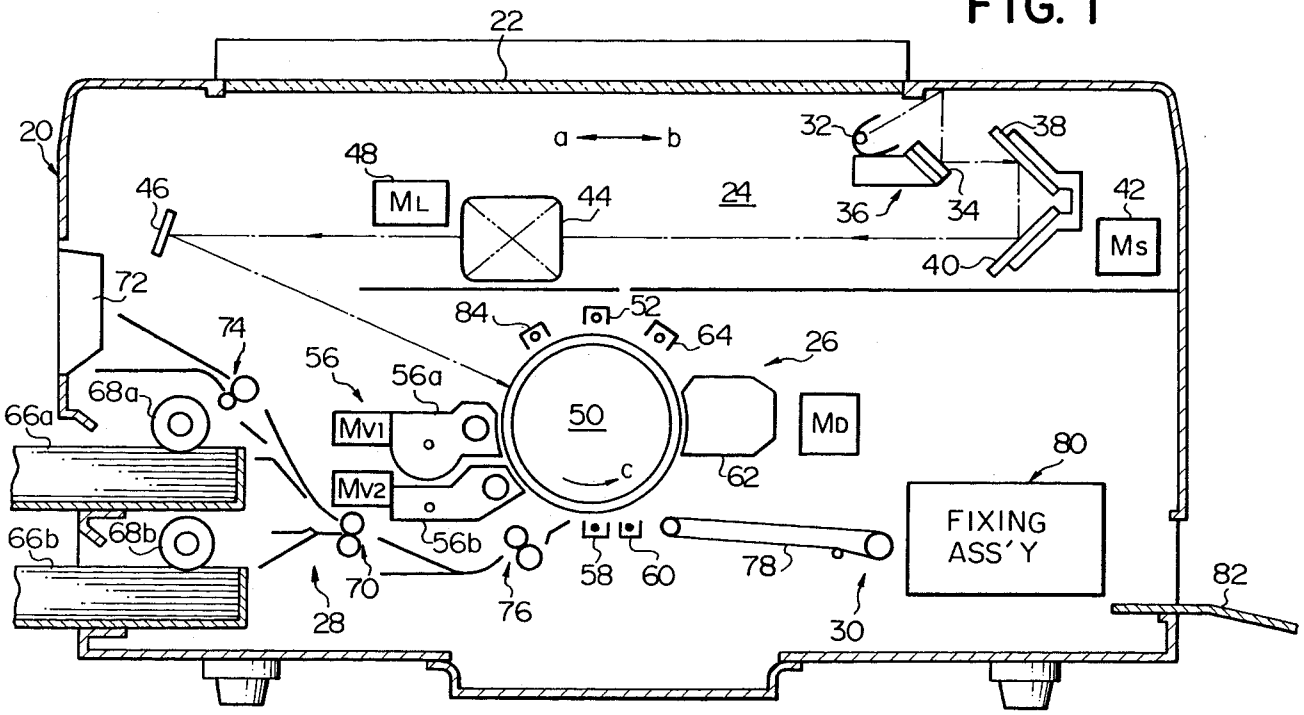
FIG. 1 is a side elevation view showing the general mechanical construction and arrangement of a preferred embodiment of an image forming apparatus according to the present invention.

As shown in FIG. 1, an image forming apparatus (hereinafter referred to simply as copying apparatus) embodying the present invention comprises a housing 20 having an upper panel portion formed in part by a transparent document table 22. A sheet of document (not shown) bearing images to be reproduced is to be placed on this document table 22.

During image duplicating operation of the apparatus, a document sheet is placed on the document table 22 and is optically scanned by irradiation with light from an optical scanning system 24. A resultant beam of light carrying information representative of the images picked up from the scanned document sheet is directed to an image reproduction system 26. The images carried by the light beam are thus provisionally recorded in the form of latent images, which are then developed into visible toner images through an electrophotographic process performed by the image reproduction system 26.

The visible toner images are transferred to any record medium such as typically a print sheet transported by a print sheet feed mechanism 28 and the print sheet now carrying the reproduced images is withdrawn out of the apparatus by means of an image-fixing and sheet discharge system 30.

The optical scanning system 24 is of the slit exposure type and comprises an exposure lamp 32 from which a beam of light is to be incident on and reflected from the lower face of the document sheet on the table 22. The light reflected from the document sheet is incident onto an object mirror 34 and is re-directed rearwardly therefrom. The lamp 32 and object mirror 34 are carried on a common movable support member and, in combination, implement an optical document scanner 36 in the image forming apparatus embodying the present invention. The optical document scanner 36 is movable forwardly along the document table 22 as indicated by arrow a and backwardly as indicated by arrow b and has a predetermined home position with respect to the document table 22.

The beam of light reflected from the object mirror 34 is re-directed toward a mirror 38, which further re-directs the light downwardly toward another mirror 40. The mirrors 38 and 40 are also carried on a common movable support member and are movable together along the document table 22 into and out of predetermined home positions with respect to the table. The optical document scanner 36 and such a mirror pair 38/40 are operatively coupled to common drive means comprising a scanner drive motor ($M_S$) implemented by a d.c. reversible motor so that the former is driven to travel typically at a speed doubling the speed of movement of the latter.

From the mirror 40, the light travels forwardly along the document table 22 and passes through an image magnification/reduction lens unit 44 to a projecting mirror 46. The lens unit 44 is movable along the document table 22 independently of the optical document scanner 36 and mirror pair 38/40 with respect to the table 22. The lens unit 44 is thus operatively coupled to drive means comprising a lens drive motor 48 ($M_L$) which may be implemented by a d.c. stepper motor. From the projecting mirror 46, light is reflected toward the image reproducing system 26. The projecting mirror 46 is herein assumed to be fixedly held with respect to the housing 20 but, where desired, may be arranged to be movable and/or rockable with respect to the housing 20.

The image reproducing system 26 of the apparatus comprises a cylindrical image transfer drum 50 having a photoconductive peripheral surface. The light reflected downwardly from the projecting mirror 46 is projected onto this image transfer drum 50 and produces positive-charged latent images on the peripheral surface of the drum 50. The image transfer drum 50 is rotatable about its center axis in a direction indicated by arrow c and is driven for rotation at a fixed peripheral speed by means of a main drive motor 52 ($M_D$) of the apparatus which may be provided independently of the scanner and lens drive motors 42 and 48.

The image reproducing system 26 further comprises a main charger 52 to sensitize the photoconductive peripheral surface of the image transfer drum 50. Posterior to the path of light from the mirror 46 to the drum 50 is located an image developing stage 56 which is herein shown as including two, upper and lower or first and second developing units 56*a* and 56*b* detachably mounted in the apparatus and each having a stock of a developer powder composed of a mixture of electrostatically charged magnetic carrier particles and black or otherwise colored toner particles. In the description to follow, it will be assumed by way of example that black-colored toner particles is stored in the first developing unit 56*a* and red-colored toner particles stored in the second developing unit 56*b*.

The image developing stage 56 further comprises drive motors $M_{V1}$ and $M_{V2}$ provided in association with the first and second developing units 56*a* and 56*b* of the stage 56. These drive motors $M_{V1}$ and $M_{V2}$ are operatively connected to the rotatable members of the developing units 56*a* and 56*b*, respectively, and are each operative to drive such members of each of the developing units 56*a* and 56*b* for rotation. Black or red toner particles are thus applied from a selected one the first and second developing units 56*a* and 56*b* to the positive-charged latent image areas of the peripheral surface of the image transfer drum 50 and form visible toner images on the drum 50, as will be described in more detail. Posterior to the developing stage 56 in turn is provided an image transfer charger 58 which is operative to charge the print sheet so that the toner images formed on the drum 50 are transferred to the print sheet. The print sheet thus having the toner images carried thereon is cleared of charges by a separation charger 60 which is located posterior to the transfer charger 58. There is further provided a drum cleaner unit 62 which removes any residual toner particles from the peripheral surface of the image transfer drum 50. Posterior to this cleaner unit 62 in turn is located a charge eraser lamp 64 which irradiates the cleaned peripheral surface of the drum 50 to eliminate the charges which may be left thereon.

The print sheet feed mechanism 28 of the copying apparatus is provided in conjunction with first and second print sheet supply cassettes 66*a* and 66*b* detachably fitted to the housing 20 and which respectively have encased therein stocks of print sheets of different sizes. The print sheet feed mechanism 28 per se comprises first and second print sheet feed rollers 68*a* and 68*b* associated with the cassettes 66*a* and 66*b*, respectively. Each of these rollers 68a and 68b is driven for rotation for picking up print sheets one after another from the stack of print sheets in the associated one of the cassettes 66a and 66b. A print sheet picked up from the first print sheet supply cassette 66a by means of the first print sheet feed roller 68a or from the second print sheet supply cassette 66b by means of the second print sheet feed roller 68b is passed through a pair of guide rollers 70 toward the image transfer drum 50. There may be further provided a manual print sheet feed slot 72 in the housing 20 so that a print sheet may be manually inserted into the housing 20 through this slot 72 and transported toward the drum 50 through a pair of guide rollers 74 and by way of the guide rollers 70.

Immediately posterior to the developing stage 56 is provided a pair of timing rollers 76. A print sheet which has been transported toward the image transfer drum 50 through the guide rollers 70 is brought into contact with the peripheral surface of the drum 50 past these timing rollers 76. The timing rollers 76 are driven for rotation at a timing synchronized with the movement of the optical document scanner 36 so that the print sheet is correctly transferred to the drum image transfer 50. The print sheet feed roller pair 68a/68b, guide roller pairs 70 and 72, and timing roller pair 76 are driven from the main drive motor ($M_D$) of the apparatus by means of respectively associated solenoid-operated clutches or other forms of actuators (not shown).

A print sheet transport belt assembly 78 is positioned posterior to the area where a print sheet to which visible toner images have been transferred from the image transfer drum 50 is to be separated from the drum 50. The print sheet separated from the drum 50 is thus conveyed rearwardly through the belt assembly 78 to an image fixing assembly 80 provided at the rear of the belt assembly 78. The toner particles carried on the print sheet are thus thermally fused and the toner images fixed on the print sheet by means of this image fixing assembly 80. The print sheet released from the image fixing assembly 80 is withdrawn from the apparatus through a print sheet discharge tray 82 attached to the housing 20 through a slot provided in the rear panel portion of the housing 20.

The copying apparatus embodying the present invention has capabilities to reproduce images within an edited mode within a specified area or areas of a print sheet. Such an edited mode of operation is performed with use of a selective charge eraser unit 84 located posterior to the main charger 54 and anterior to the developing stage 56.

Figure 2:
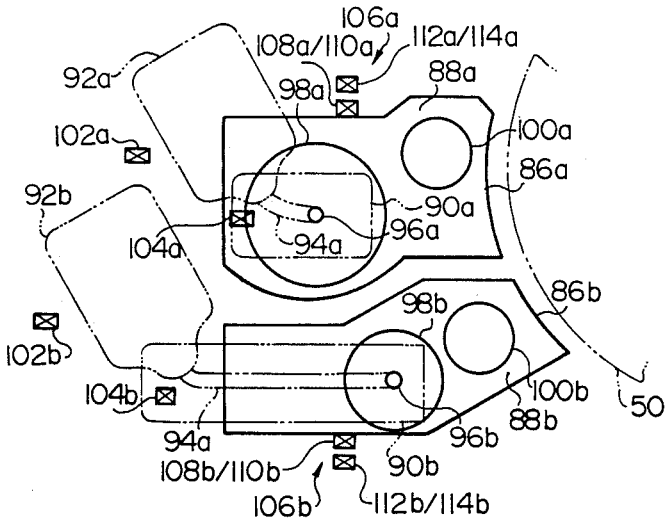
FIG. 2 is a cross sectional view showing the detailed construction of an image developing stage included in the image forming apparatus illustrated in FIG. 1.
Figure 3:
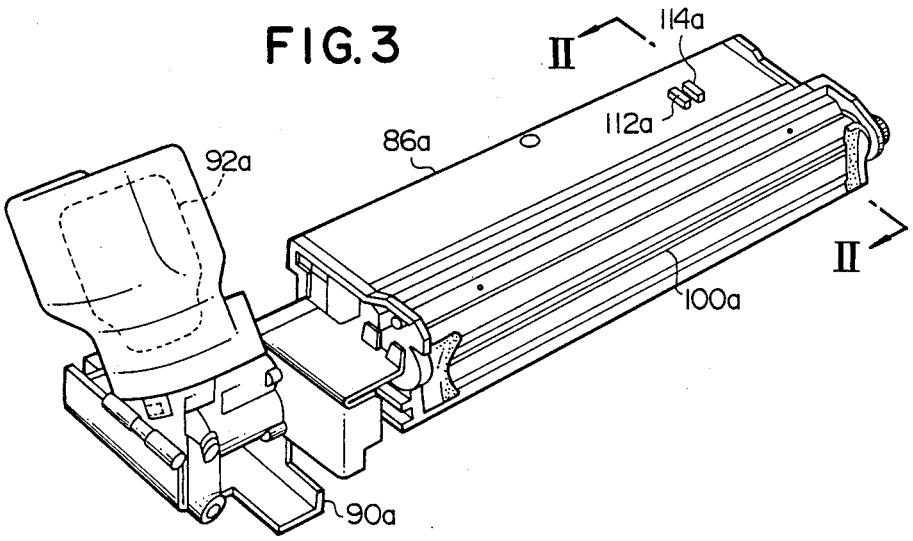
FIG. 3 is a perspective view showing part of the image developing stage illustrated in FIG. 2, the cross sectional view of FIG. 2 being taken along line II—II in FIG. 3.

FIGS. 2 and 3 show the detailed construction of the developing stage 56 which forms part of the image forming apparatus embodying the present invention.

As shown, the first developing unit 56a comprises a housing 86a having a powder feed chamber 88a defined therein. Electrostatically charged carrier particles are preliminarily stored in the powder feed chamber 88a thus provided in the housing 86a. The housing 86a of the first developing unit 56a further has a longitudinal end wall portion forming a bracket 90a by means of which a toner storage container 92a is detachably fitted to the housing 86a as indicated by dots-and-dash lines in FIG. 3. Toner particles of a certain color such as black as herein assumed are stored in this toner storage container 92a and are supplied into the powder feed chamber 88a through a toner feed tube 94a leading from the container 92a. The toner feed tube 94a is secured to the housing 86a and terminates at an outlet end 96a which is open into the powder feed chamber 88a as also indicated by dots-and-dash lines in FIG. 3.

Positioned within the powder feed chamber 88a is a bucket roller 98a having opposite end portions journaled in opposite end walls, respectively, of the housing 86a. The bucket roller 98a is rotatable about an axis parallel with the axis of rotation of the image transfer drum 50 and, though not shown in the drawings, has mixing blades arranged about the axis of rotation thereof. The black-colored toner particles supplied from the toner storage container 92a into the powder feed chamber 88a by way of the toner feed tube 98a are mixed with the electrostatically charged carrier particles preliminarily stored in the powder feed chamber 88a to form a mixture of the charged carrier particles and black-colored toner particles in the powder feed chamber 88a. The mixture of the carrier and toner particles is agitated by the mixing blades of the bucket roller 98a so that the toner particles are brought into frictional contact with the carrier particles and are thus electrostatically charged to, for example, the negative polarity by means of the carrier particles. A developing powder consisting of such a mixture of carrier and toner particles is distributed from the vicinity of one end of the powder feed chamber 88a to the vicinity of the other by means of the bucket roller 98a. The bucket roller 98a is driven for rotation by the drive motor $M_{V1}$ (FIG. 1) which forms part of the first developing unit 56a.

Within the powder feed chamber 88a is further provided a cylindrical toner applicator sleeve 100a positioned between and in parallel with the bucket roller 98a and image transfer drum 50. The applicator sleeve 100a also has opposite end portions journaled in the opposite end walls, respectively, of the housing 86a and is rotatable about an axis parallel with the axis of rotation of the bucket roller 98a. The developer powder distributed in the powder feed chamber 88a by means of the bucket roller 98a as above described is fed from the bucket roller 98a to the applicator sleeve 100a as the roller 98a and sleeve 100a are driven for rotation about their respective axes of rotation. The applicator sleeve 100a is positioned close to the image transfer drum 50 to form a gap between the peripheral surface of the drum 54 and the outer peripheral surface of the applicator sleeve 100a. The applicator sleeve 100a is also driven for rotation by means of the drive motor $M_{V1}$ (FIG. 1) of the first developing unit 56a.

The construction and arrangement of the second developing unit 56b is essentially similar to that of the first developing unit 56a and, as such, the component members and units forming part of the former are represented by like reference numerals with a subscript b affixed to each of the numerals. Thus, the second developing unit 56b comprises a housing 86b having a powder feed chamber 88b and a longitudinal end wall portion forming a bracket 90b, a toner storage container 92b detachably fitted to the housing 86b, a toner feed tube 94b leading from the container 92a and terminates at an outlet end 96b, a bucket roller 98b, and a toner applicator sleeve 100b.

Various sensors and detectors are provided in association with the image developing stage 56 constructed and arranged as hereinbefore described. These sensors and detectors include a first container presence/absence sensor 102a located in conjunction with the toner storage container 92a which may be fitted to the first developing unit 56a and a second container presence/absence sensor 102b located in conjunction with the toner storage container 92b which may be fitted to the second developing unit 56b. Each of these container presence/absence sensors 102a and 102b is adapted to detect the presence or absence of a toner storage container fitted to the associated developing unit 56a or 56b and produce a signal $S_{P1}$ (from the first container presence/absence sensor 102a) or a signal $S_{P2}$ (from the first container presence/absence sensor 102b) of a logic "1" state or a logic "0" state in the presence or absence, respectively, of a toner storage container fitted to the associated developing unit 56a or 56b.

The sensors and detectors provided in association with the image developing stage 56 further include a first container empty sensor 104a located in the vicinity of the outlet end of the toner storage container 92a fitted to the first developing unit 56a and a second container empty sensor 104b located located in the vicinity of the toner storage container 92b fitted to the second developing unit 56b. Each of these container empty sensors 104a and 104b is adapted to detect the presence or absence of toner particles in the toner storage container fitted to the associated developing unit 56a or 56b and produce a signal $S_{E1}$ (from the first container empty sensor 104a) or a signal $S_{E2}$ (from the second container sensor 104b) of a logic "1" state or a logic "0" state in the presence or absence, respectively, of toner particles in the toner storage container fitted to the associated developing unit 56a or 56b.

In association with the developing stage 56 of the apparatus embodying the present invention are further provided first and second color sensors 106a and 106b arranged in conjunction with the first and second developing units 56a and 56b, respectively. Each of these first and second color sensors 106a and 106b comprises two or less magnet elements located on the housing 86 of the developing unit 56a or 56b and a pair of switches respectively associated with the two or less magnet elements. Thus, the first color sensor 106a may comprise no magnet element, a single magnet element 108a or 110a or two magnet elements 108a and 110a and a pair of detector switches 112a and 114a. The detector switches 112a and 114a may have no associated magnet elements or two respectively associated magnet elements 108a and 110a. Otherwise, one detector switch 112a may have no associated magnet element and the other detector switch 114a may have an associated magnet element 110a or, alternatively, one detector switch 112a may have an associated magnet element 108a and the other detector switch 114a may have no associated magnet element. Likewise, the second color sensor 106b may comprise no magnet element, a single magnet element 108b or 110b or two magnet elements 108b and 110b and a pair of detector switches 112b and 114b. The detector switches 112b and 114b may have no associated magnet elements or two respectively associated magnet elements 108b and 110b. Otherwise, one detector switch 112b may have no associated magnet element and the other detector switch 114b may have an associated magnet element 110b or, alternatively, one detector switch 112b may have an associated magnet element 108b and the other detector switch 114b may have no associated magnet element.

In the meantime, it is herein assumed by way of example that there are available four different print colors with use of black, red (or magenta), yellow and blue (cyan) toner particles. It is further assumed that the magnet elements 108a and/or 110a of the first color sensor 106a and the magnet elements 108b and/or 110b of the second color sensor 106b are arranged such that the detector switches 112a and 114a or the detector switches 112b and 114b produce signals $S_{C1}$ and $S_{C2}$ each of a logic "1" or "0" state depending on the four different print colors in accordance with the following schedules:

| Signal $S_{C1}$ | Signal $S_{C2}$ | Toner Color |
|---|---|---|
| "1" | "1" | Black |
| "1" | "0" | Red |
| "0" | "1" | Yellow |
| "0" | "0" | Blue |

As noted previously, it is herein assumed that the first and second developing units 56a and 56b have stored therein black and red colored toner particles, respectively. With such developing units 56a and 56b, the detector switches 112a and 114a of the first color sensor 106a associated with the first developing unit 56a produce signals each of a logic "1" state and the detector switches 112b and 114b of the second color sensor 106b associated with the second developing unit 56b produce signals of logic "1" and "0" states as will be seen from the table.

Figure 4:
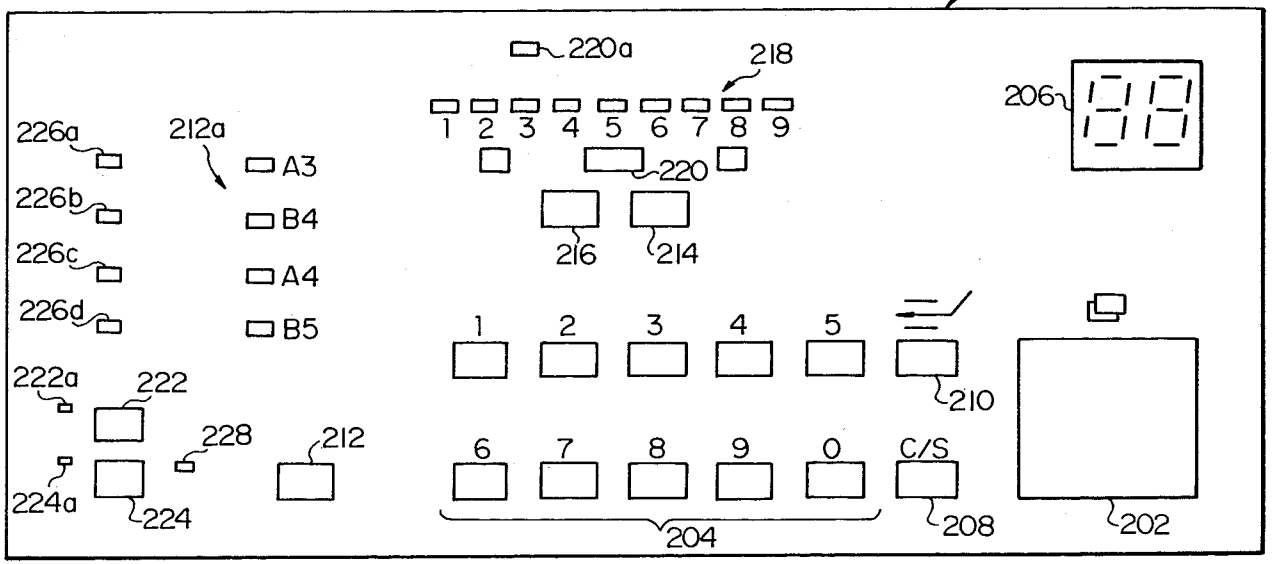
FIG. 4 is a plan view schematically showing the general configuration of a control panel further included in the image forming apparatus embodying the present invention.

FIG. 4 shows the general configuration of a control panel 200 which forms part of the apparatus embodying the present invention. The control panel 200 comprises a print start switch 202 to enable the apparatus to start a cycle or a series of cycles of printing operation and a set of numerical switches 204 allocated to numerals 1, 2, . . . and 0, respectively, and used to enter a selected quantity of printed outputs. The quantity of printed outputs thus entered from the numerical switches 204 is displayed on a two-digit numerical data display window 206 and can be cleared from a clear/stop switch 208 (C/S) which may be used also for cancelling the instruction once entered from the print start switch 202. During printing for a preset quantity of printed outputs for a given document sheet, it may be desired to interrupt the current printing operation and produce a copy of another document sheet. An interrupt mode request switch 21 is thus provided to allow the operator to select such an interrupt mode of copying operation.

The size of print sheets to be used can be selected at a manual paper-size select switch 212 from among a predetermined number of sizes available. The selected size of print sheets, such as any of the standard A3, B4, A4 and B5 sizes as shown, is displayed by any of paper-size indicators which are collectively indicated at 212a. The paper-size select switch 212 is, in effect, used to select one of the paper supply cassettes 66a and 66b installed on the apparatus shown in FIG. 1.

On the control panel 200 are further provided exposure value increment and decrement switches 214 and 216 establish a manual exposure value select mode permitting manual selection of an exposure value to produce a desired print density with which toner images are to be formed on a print sheet. The exposure value increment and decrement switches 214 and 216 are in effect used to manually select the intensity of illumination, or "exposure value" as herein referred to, from the exposure lamp 32 of the optical document scanner 36. The manually selected exposure value, $E_{MAN}$, of the optical document scanner 36 and accordingly the print density are thus stepwise incremented or decremented through use of the exposure value increment and decrement switch 214 or 216. A series of exposure value display indicators 218 are activated to illuminate successively in one direction with the increment switch 214 kept depressed and in the other direction with the decrement switch 216 kept depressed. The indicators 218 are herein assumed to consist of first to ninth indicators allocated to stepwise increasing nine different preset degrees of exposure value which are represented by the numerals respectively indicated below the individual indicators. The exposure value can be fixed at a predetermined value $E_{AUTO}$ automatically by selecting an automatic density select mode at a switch 220. When the automatic exposure value select switch 220 is depressed, an indicator 220*a* associated with the switch 220 is turned on to illuminate to indicate that such a mode of exposure value control is selected so that toner images are to be produced with the prescribed exposure value $E_{AUTO}$. The exposure value $E_{AUTO}$ to be selected from the automatic exposure value select switch 220 is predetermined be optimum for producing printed images of each of the print colors available.

Furthermore, the color of the images to be printed can be selected from among different available colors at first and second color select switches 222 and 224 having associated indicators 222*a* and 224*a*, respectively. These first and second color select switches 222 and 224 are in effect operative to select one of the developing units 56*a* and 56*b* of the image developing stage 56 of the apparatus shown in FIG. 1. When the color select switch 222 or 224 is depressed, the indicator 222*a* associated with the first color select switch 222 or the indicator 224*a* associated with the second color select switch 224 is turned on to illuminate to indicate that black or red is selected as the print color to be used for the printing operation to be started. With the switch 222 or the switch 224 thus depressed, any one of color indicators 226*a*, 226*b*, 226*c* and 226*d* respectively allocated to different print colors such as black, red, yellow and blue as previously noted is turned on to illuminate on the basis of the signals $S_{C1}$ and $S_{C2}$ from each of the color sensors 106*a* and 106*b* described with reference to FIGS. 2 and 3. In the apparatus embodying the present invention, the color indicator 226*a* allocated to the black print color is to be turned on with the first color select switch 222 depressed and the color indicator 226*b* allocated to the red print color is to be turned on when the second color select switch 224 is depressed.

On the control panel 200 is further provided an indicator 228 which is responsive to the signals from the container empty sensors 104*a* and 104*b*. This indicator 228 is turned on to illuminate or flicker in the presence of the signal $S_{E1}$ of logic "0" state from the first container empty sensor 104*a* or the signal $S_{E2}$ of logic "0" state from the second container sensor 104*b*. Thus, the indicator 228' when illuminating or flickering, indicates that there is no stock of toner particles in the toner storage container 92*a* or 92*b* fitted to the developing unit 56*a* or 56*b* selected from the switch 222 or 224, respectively.

On the control panel 200 are provided various other switches and indicators. These switches and indicators are however rather immaterial to the understanding of the subject matter of the present invention and, as such, are not herein shown and described.

Figure 5:
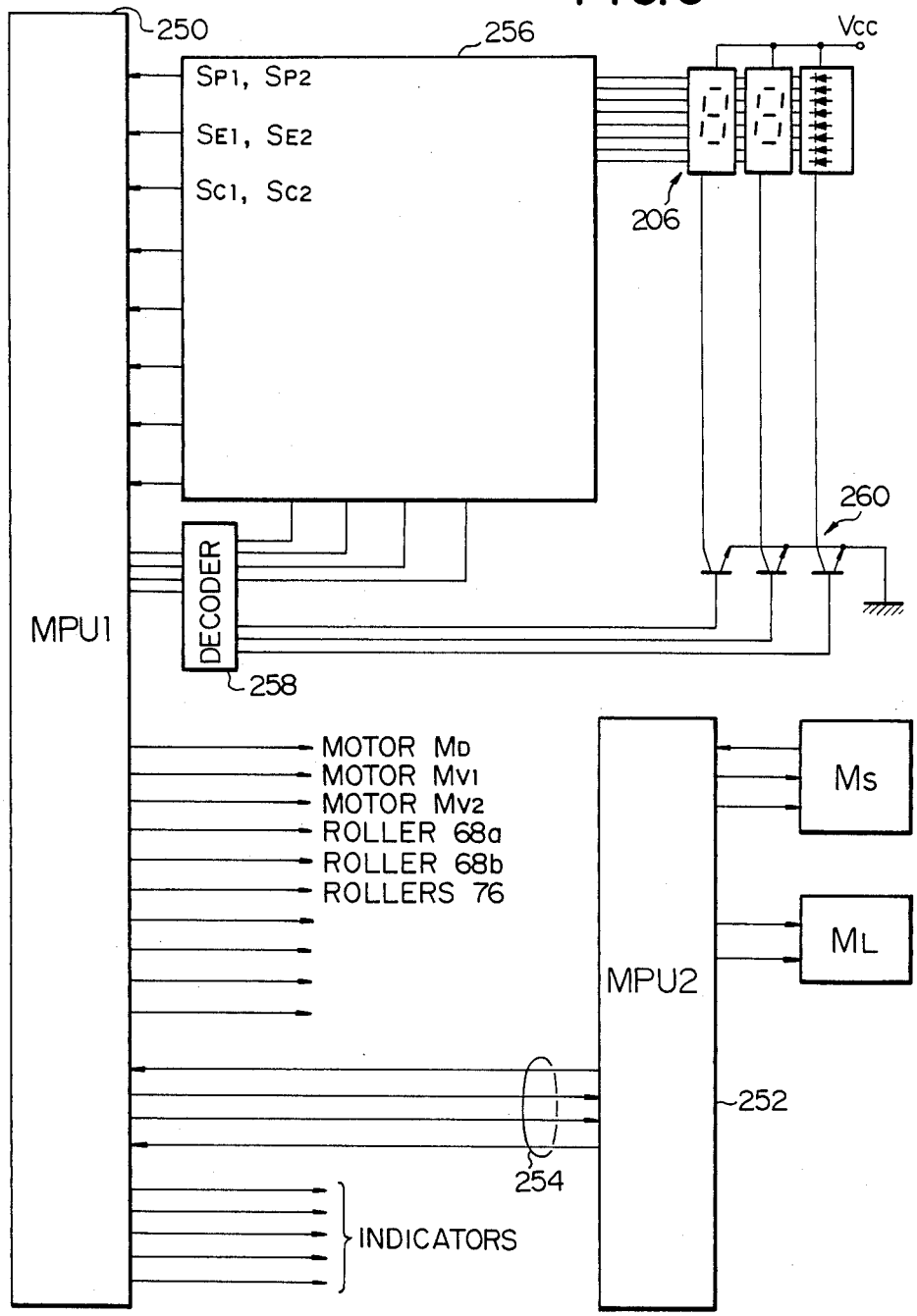
FIG. 5 is a block diagram showing the general configuration of a control system which may further form part of the image forming system embodying the present invention.

FIG. 5 shows the general arrangement of a control circuit which may be used to achieve the functions achievable from the control panel 200 hereinbefore described with reference to FIG. 4.

The control circuit comprises first and second microprocessor units 250 and 252 (MPU1 and MPU2) each of which has an interrupt port INT and data input and output ports $S_{IN}$ and $S_{OUT}$ connected to those of the other microprocessor unit through bus lines 254. Generally, the first microprocessor unit 250 is operative to control the operation of the image reproducing system 26 and print sheet feed mechanism 28 while the second microprocessor unit 252 is predominant over the operation of the optical scanning system 24.

The first microprocessor unit 250 has input terminals connected to a matrix circuit 256 composed of various switch elements including those on the control panel 200 and those provided in conjunction with the image developing stage 54. To the first microprocessor unit 250 are thus supplied signal including the signals $S_{P1}$ and $S_{P2}$ from the container presence/absence sensors 102*a* and 102*b*, the signals $S_{E1}$ and $S_{E2}$ from from the container empty sensors 104*a* and 104*b*, the signals $S_{C1}$ and $S_{C2}$ from each of the color sensors 106*a* and 106*b* and the signals from the various switches provided on the control panel 200. Signals are further supplied through the matrix circuit 256 to the microprocessor unit 250 from the segment electrodes forming the display window 206 on the control panel 200.

The microprocessor unit 250 further has output terminals including those connected through an address decoder 258 to the matrix circuit 256 and to switch elements 260 for activating the display window 206. The microprocessor unit 250 further has terminals A1 to A8 connected to drivers and actuators for the various electrically driven or solenoid-operated units. These drivers and actuators include the driver for the main drive motor $M_D$, the drivers for the image developer drive motors $M_{V1}$ and $M_{V2}$, the clutches for the print sheet feed rollers 68*a* and 68*b*, the clutches for the timing roller pair 76, the actuators for the chargers 52 and 58 and charge eraser unit 84, and the actuators for the various indicators provided on the control panel 200. Though not shown, the first microprocessor unit 250 is further connected to a read-only memory (ROM) in which are stored the programs dictating various operating modes and conditions of the apparatus be stored and a random-access memory (RAM) into which are to be stored the various instructions and data entered through the switches on the control panel 200 or produced by the sensors and detectors provided in the apparatus.

The second microprocessor unit 252 has input terminals connected to the various sensors provided in association with the optical scanning system 24 though not shown and is operative to control the driver circuits for the scanner drive motor $M_S$ and the stepper motor $M_L$ for the magnification lens unit 44. The second microprocessor unit 252 is connected to the first microprocessor unit 250 via the bus line 254 and, thus, controls the operation of the motors $M_S$ and $M_L$ under the control of the first microprocessor unit 250 through the bus lines 254.

Main Routine Program

Figure 6:
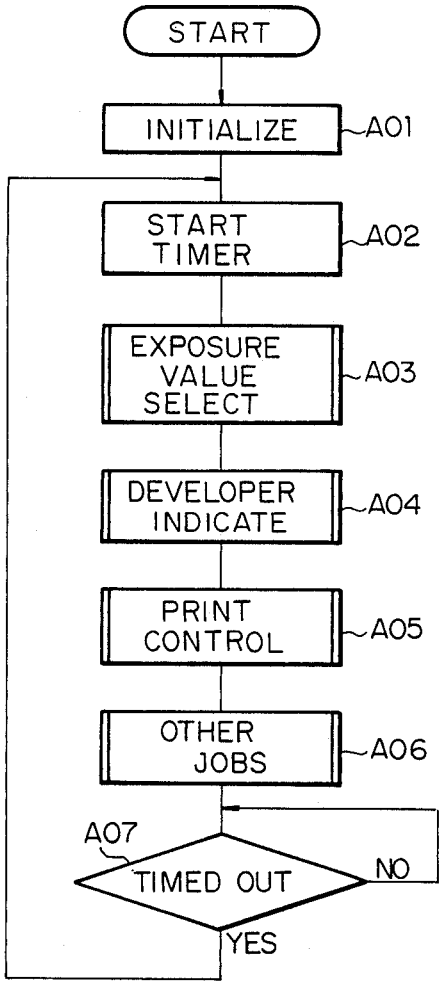
FIG. 6 is a flowchart showing an example of the main routine program to be executed by the control circuit illustrated in FIG. 5.

FIG. 6 is a flowchart showing an example of the main routine program to be executed by the first microprocessor unit 250 provided in the control circuit hereinbefore described with reference to FIG. 5. The routine program starts with the apparatus switched in and first initializes the microprocessor unit 250 at a step A01 so that all the conditions and modes of operation to be controlled by means of the microprocessor unit 250 are selected in accordance with prescribed default rules. An internal timer of the first microprocessor unit 250 is then initiated at step A02 to count the time interval predetermined for a single complete iteration through the routine program.

The first microprocessor unit 250 may then execute an exposure value select subroutine program A03 through which the exposure value $E_{MAN}$ manually selected by the operator by manipulation of the exposure value increment or decrement switch 214 or 216 or the prescribed exposure value $E_{AUTO}$ automatically selected through manipulation of the automatic exposure value select switch 220 is established and memorized into the random-access memory provided in association with the microprocessor unit 250. The details of the exposure value select subroutine program A03 will be hereinafter described with reference to FIGS. 7A and 7B.

The exposure value select subroutine program A03 may be followed by a selected developer indicate subroutine program A04 to detect the developing unit selected for use and indicate the color of the selected developer by one of the color indicators **226*a* to 226*d* on the control panel 200. The details of this selected developer indicate subroutine program A04 will be hereinafter described with reference to FIGS. 8A and 8B**.

The first microprocessor unit 250 may thereafter execute a print control subroutine program A05 to control various phases and aspects of the printing operation to be performed by the apparatus. Through this subroutine program A05 may thus be controlled the temperature to which the print sheet is to be heated while being passed through the image fixing assembly 80. The print control subroutine program A05 may be followed by a subroutine program A06 through which various instruction and data signals supplied from the control panel 200 are processed and instructions are generated to update the numerical data on the display window 206 of the control panel 200. When it is thereafter detected at step A07 that the counting of the time interval as started at step A02 has terminated, the main routine program reverts to the step A02 and recycles the subroutine programs A03 to A06.

Description will be hereinafter made with reference to FIGS. 7A and 7B to FIGS. 9A to 9B in regard to some of the subroutine programs thus included in the main routine program.

Exposure Value Select Subroutine Program (A03)

Figure 7A:
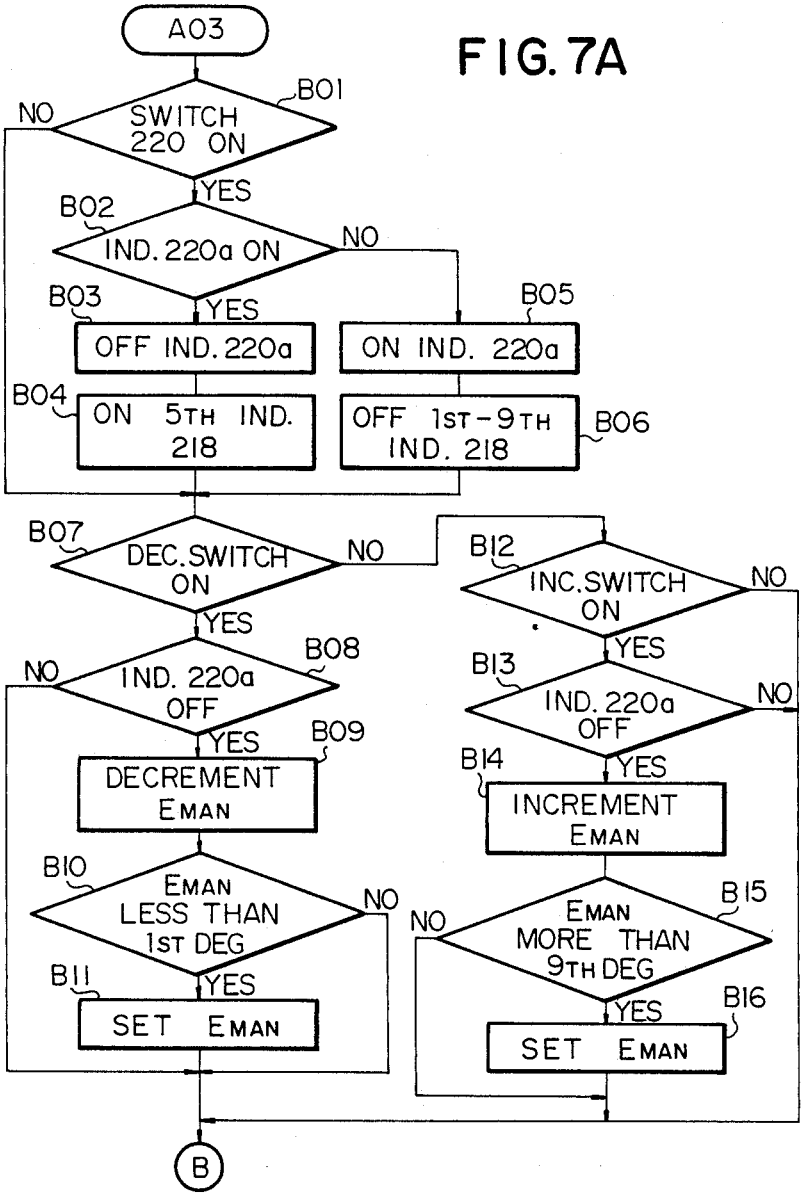
FIGS. 7A and 7B are flowchart showing the details of the exposure value select subroutine program included in the main routine program illustrated in FIG. 6.
Figure 7B:
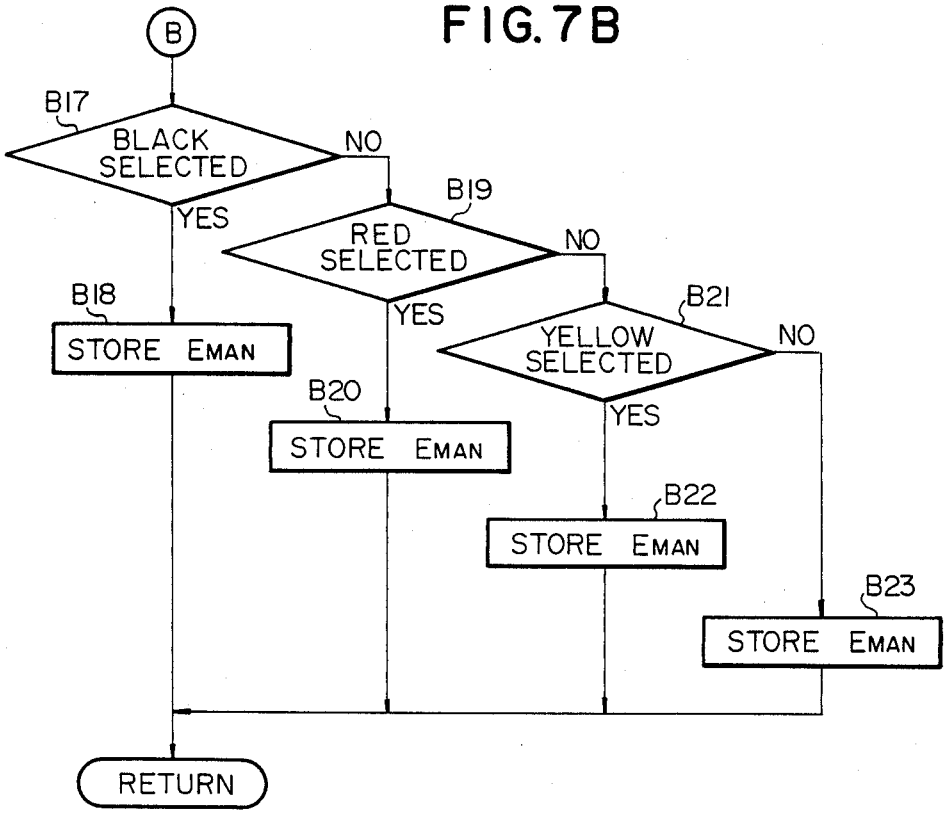

FIGS. 7A and 7B show the details of the exposure value select subroutine program A03 included in the main routine program hereinbefore described with reference to FIG. 6. The exposure value select subroutine program A03 includes steps which are largely broken down to three blocks of steps which consist of a first block 7/I of steps to select and establish either the manual exposure value select mode to permit manual selection of the exposure value or the automatic exposure value select mode to select the exposure value prescribed for the selected print color, a second block of steps 7/II to establish the exposure value selected through manipulation of the exposure value increment or decrement switch 214 or 216, a third block of steps 7/III to store the data representative of the selected exposure value into the random-access memory associated with the microprocessor unit 250.

Thus, the first block of steps 7/I of the subroutine program A03, shown in FIG. 7A, starts with a decision step B01 to detect whether or not the automatic exposure value select mode is selected through manipulation of the automatic exposure value select switch 220. If it is found at this step B01 that the automatic exposure value select mode is selected with the switch 220 depressed, it is further detected at step B02 whether or not the indicator **220*a* associated with the automatic exposure value select switch 220 is turned on and illuminating. If the answer for this step B02 is given in the affirmative, it is determined that the automatic exposure value select switch 220 is depressed to make a shift to the manual exposure value select mode under the condition in which the automatic exposure value select mode has been established. Thus, the indicator 220*a* is turned off at step B03 and, thereupon, the indicator 218 allocated to the fifth preset degree of exposure value is activated to illuminate on the control panel 200 at step B04. If the answer for the step B02 is given in the negative, then it is determined that the automatic exposure value select switch 220 is depressed to make a shift to the automatic exposure value select mode under the condition in which the manual exposure value select mode has been established. Thus, the indicator 220*a* associated with the automatic exposure value select switch 220 is turned on to illuminate at step B05 and, thereupon, all of the indicators 218 allocated to the first to ninth preset degrees of exposure value are turned off at step B06**.

Subsequently to step B04 or to step B06 or when it is found at step B01 that the automatic exposure value select mode is not selected, the subroutine program A03 proceeds to the second block of steps 7/II also shown in FIG. 7A and detects at step B07 whether or not there is a signal produced through manipulation of the exposure value decrement switch 216. If it is found that there is such a signal present, it is further tested at step B08 whether or not the indicator **220*a* associated with the automatic exposure value select switch 220 is turned off. If the answer for this step B08 is given in the affirmative with the indicator 220*a* found to be turned off, the step B08 is followed by a step B09 at which the exposure value $E_{MAN}$, viz., the manually controlled print density is decremented a single step between the preset degrees of exposure value represented by any adjacent two of the indicators 218. Thereupon, it is detected at step B10 whether or not the exposure value currently effective is less than the first, viz., lowest preset degree and, if the answer for this step B10 is given in the affirmative, the step B10 is followed by a step B11 at which the exposure value to be achieved by the exposure lamp 32** is selected at the first preset degree.

Subsequently to the step B11 or if it is found at step B08 that the indicator **220*a* associated with the automatic exposure value select switch 220 is not turned off or at step B10 that the exposure value currently effective is not less than the first preset degree, then the step B08, step B10 or step B11 is followed by the third block of steps 7/III**.

If it is determined at step B07 that there is no signal produced through manipulation of the exposure value decrement switch 216, it is tested at step B12 whether or not there is a signal produced through manipulation of the exposure value increment switch 214. If the answer from this step B12 is given in the negative, then the step B12 is followed by the third block of steps 7/III. If it is found at step B12 that there is a signal produced with the exposure value increment switch 214 depressed, it is further tested at step B13 whether or not the indicator 220a associated with the automatic exposure value select switch 220 is turned off. If the answer for this step B13 is given in the affirmative with the indicator 220a found to be turned off, the step B13 is followed by a step B14 at which the exposure value $E_{MAN}$, viz., the manually controlled print density is incremented a single step between the preset degrees of exposure value represented by any adjacent two of the indicators 218. Thereupon, it is detected at step B15 whether or not the exposure value currently effective is higher than the ninth, vi., highest preset degree and, if the answer for this step B15 is given in the affirmative, the step B15 is followed by a step B16 at which the exposure value to be achieved by the exposure lamp 32 is selected at the ninth preset degree.

Subsequently to the step B16 or if it is found at step B13 that the indicator 220a associated with the automatic exposure value select switch 220 is not turned off or at step B15 that the exposure value currently effective is not higher than the ninth preset degree, then the step B13, step B15 or step B16 is also followed by the third block of steps 7/III.

In the third block of steps 7/III illustrated in FIG. 7B, it is first detected at step B17 whether or not the developing unit storing black-colored toner particles is currently selected. If the answer for this step B17 is given in the affirmative, the data representative of the manually selected exposure value $E_{MAN}$ as has been set at any of the preceding steps B09, B11, B14 and B16 is stored into a specified area of the random-access memory provided in association with the first microprocessor unit 250 as at step B18. If it is found at step B17 that the developing unit storing black-colored toner particles is currently not selected, it is tested at step B19 whether or not the developing unit storing red-colored toner particles is currently selected. If the answer for this step B19 is given in the affirmative, the data representative of the manually selected exposure value $E_{MAN}$ as has been set at any of the preceding steps B09, B11, B14 and B16 is stored into the specified area of the random-access memory associated with the microprocessor unit 250 as at step B20.

If it is found at step B19 that the developing unit storing red-colored toner particles is currently not selected, it is tested at step B21 whether or not the developing unit storing yellow-colored toner particles is currently selected. If the answer for this step B21 is given in the affirmative, the data representative of the manually selected exposure value $E_{MAN}$ as has been set at any of the preceding steps B09, B11, B14 and B16 is stored into the specified area of the random-access memory associated with the microprocessor unit 250 as at step B22. If it is found at step B21 that the developing unit storing yellow-colored toner particles is currently not selected, it is determined that it is the blue-colored toner particles that have been selected for use and, as such, the data representative of the manually selected exposure value $E_{MAN}$ as has been set at any of the preceding steps B09, B11, B14 and B16 is stored into the specified area of the random-access memory associated with the microprocessor unit 250 as at step B23. Each of the tests at steps B17, B19 and B21 is made on the basis of the signals $S_{C1}$ and $S_{C2}$ supplied from the color sensors 106a and 106b associated with the developing units 56a and 56b of the image developing stage 56 as previously described. Subsequently to any of the steps B18, B20, B22 and B23, the microprocessor unit 250 reverts to the main routine program illustrated in FIG. 6 and proceeds to the subroutine program A04 thereof.

Selected Developer Indicate Subroutine Program (A04)

Figure 8A:
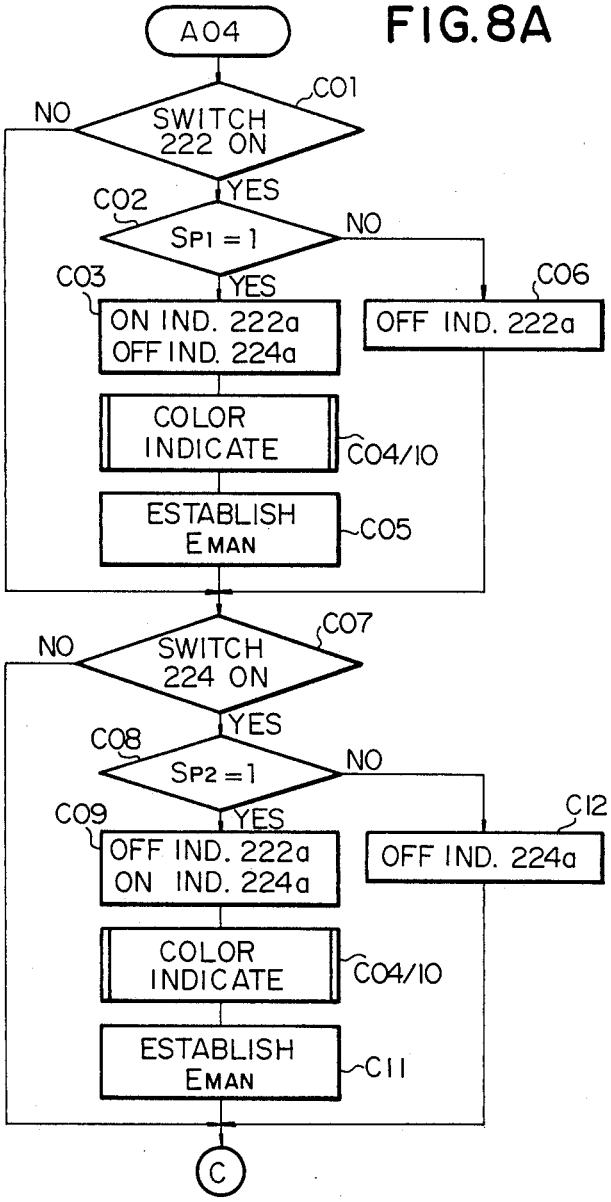
FIGS. 8A and 8B are flowchart showing the details of the selected developer indicate subroutine program also included in the main routine program illustrated in FIG. 6.
Figure 8B:
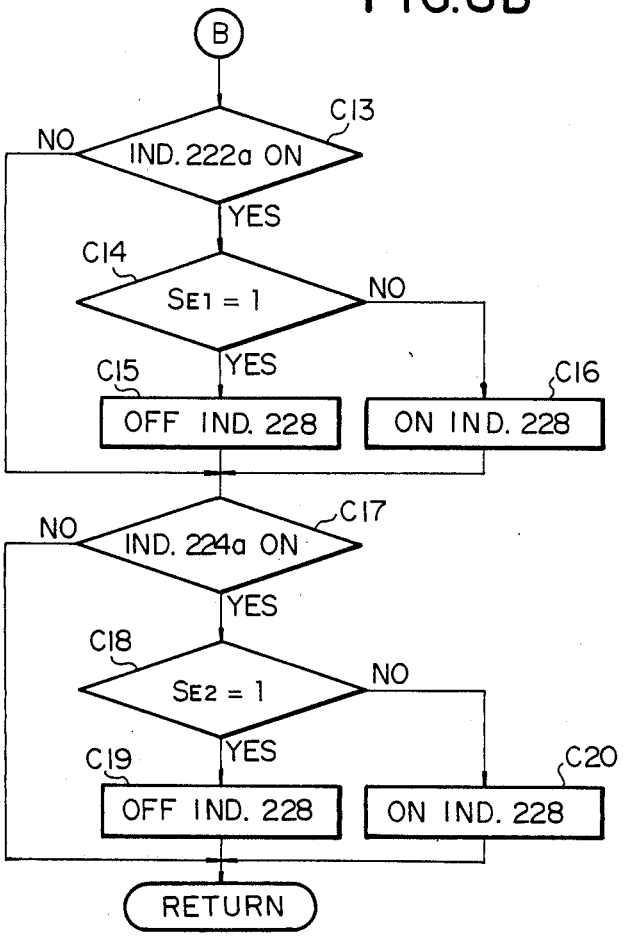

FIGS. 8A and 8B show the details of the selected developer indicate subroutine program A04 included in the main routine program hereinbefore described with reference to FIG. 6. The selected developer indicate subroutine program A03 includes steps which are largely broken down to four blocks of steps which consist of a first block 8/I of steps through which, when the first developing unit 56a is selected for use, the print color available by the developing unit 56a is selected and indicated on the control panel 200, a second block of steps 8/II of steps through which, when the second developing unit 56b is selected for use, the print color available by the developing unit 56b is selected and indicated on the control panel 200, a third block of steps 8/III of steps through which, when the first developing unit 56a is selected for use, it is detected that there is a stock of toner particles in the toner storage container 92a currently fitted to the developing unit 56a and thereupon the result of the detection is indicated on the control panel 200, and a fourth block of steps 8/IV of steps through which, when the second developing unit 56b is selected for use, it is detected that there is a stock of toner particles in the toner storage container 92b currently fitted to the developing unit 56b and thereupon the result of the detection is indicated on the control panel 200.

Thus, the first block of steps 8/I of the subroutine program A04, shown in FIG. 8A, starts with a decision step C01 to detect whether or not there is a signal produced with the first color select switch 222 depressed. If it is found at this step C01 that there is such a signal present, it is further tested at step C02 whether or not there is a signal $S_{P1}$ of logic "1" state from the first container presence/absence sensor 102a. If the answer for this step C02 is given in the affirmative, the step C02 is followed by step C03 at which the indicator 222a associated with the first color select switch 222 is turned on to illuminate and the indicator 224a associated with the second color select switch 224 is turned off. Subsequently to the step C03, a subroutine program C04/10 is executed whereby the print color available from the toner particles currently stored in the first developing unit 56a is indicated by any of the indicators 226a to 226d on the control panel 200. The details of this selected print color indicate subroutine program C04/10 will be hereinafter described with reference to FIGS. 9A and 9B.

After execution of the subroutine program C04/10, the subroutine program A04 proceeds to step C05 at which the data representative of the manually or automatically selected exposure value $E_{MAN}$ or $E_{AUTO}$ for the print color indicated by any of the indicators 226a to 226d is fetched from the random-access memory to control the optical document scanner 36 to produce the particular exposure value $E_{MAN}$ or $E_{AUTO}$. When the manually selected exposure value $E_{MAN}$ is established used, one of the indicators 218 allocated to the corresponding preset degree of exposure value is activated to illuminate.

If it is determined at step C02 that there is a signal $S_{P1}$ of logic "0" state from the first container presence/absence sensor 102a, the step C02 is followed by step C06 at which the indicator 222a associated with the first color select switch 222 is turned off. Subsequently to step C05 or step C06 or when it is detected at step C01 that there is no signal produced with the first color select switch 222 depressed, the subroutine program A04 proceeds to the second block of steps 8/II.

In the second block of steps 8/II, it is first confirmed at a decision step C07 whether or not there is a signal produced with the second color select switch 224 depressed. If it is found at this step C07 that there is such a signal present, it is further tested at step C08 whether or not there is a signal $S_{P2}$ of logic "1" state from the second container presence/absence sensor 102b. If the answer for this step C08 is given in the affirmative, the step C08 is followed by step C09 at which the indicator 224a associated with the first color select switch 224 is turned off and the indicator 224a associated with the second color select switch 224 is turned on to illuminate. Subsequently to the step C09, the subroutine program C01/10 is executed whereby the print color available from the toner particles currently stored in the second developing unit 56b is indicated by any of the indicators 226a to 226d on the control panel 200.

After execution of the subroutine program C04/10, the subroutine program A04 proceeds to step C11 at which the data representative of the manually or automatically selected exposure value $E_{MAN}$ or $E_{AUTO}$ for the print color indicated by any of the indicators 226a to 226d is fetched from the random-access memory to control the optical document scanner 36 to produce the particular exposure value $E_{MAN}$ or $E_{AUTO}$.

If it is determined at step C08 that there is a signal $S_{P2}$ of logic "0" state from the second container presence/ absence sensor 102b, the step C08 is followed by step C12 at which the indicator 224a associated with the second color select switch 224 is turned off. Subsequently to step C11 or step C12 or when it is detected at step C07 that there is no signal produced with the second color select switch 224 depressed, the subroutine program A04 proceeds to the third block of steps 8/III shown in FIG. 8B.

In the third block of steps 8/III, it is confirmed at step C13 whether or not the indicator 222a associated with the first color select switch 222 is turned on. If the answer for this step C13 is given in the affirmative, it is further tested at step C14 whether or not there is a signal $S_{E1}$ of logic "1" state from the first container empty sensor 104a. If the answer for this step C14 is also given in the affirmative, the step C14 is followed by step C15 at which the indicator 228 is turned off to indicate that there is a stock of toner particles in the toner storage container 92a fitted to the first developing unit 56a selected from the switch 222. If it is determined at step C14 that there is a signal $S_{E1}$ of logic "0" state from the first container empty sensor 104a, the step C14 is followed by step C16 at which the indicator 228 is turned on to indicate that there is no stock of toner particles in the toner storage container 92a fitted to the first developing unit 56a.

Subsequently to the step C15 or step C16 or when it is detected at step C13 that the indicator 222a associated with the first color select switch 222 is turned off, the subroutine program A04 proceeds to the fourth block of steps 8/IV.

In the fourth block of steps 8/IV, it is confirmed at step C17 whether or not the indicator 224a associated with the second color select switch 224 is turned on. If the answer for this step C17 is given in the affirmative, it is further tested at step C18 whether or not there is a signal $S_{E2}$ of logic "1" state from the second container empty sensor 104b. If the answer for this step C18 is also given in the affirmative, the step C18 is followed by step C19 at which the indicator 228 is turned off to indicate that there is a stock of toner particles in the toner storage container 92b fitted to the second developing unit 56b selected from the switch 224. If it is determined at step C18 that there is a signal $S_{E2}$ of logic "0" state from the second container empty sensor 104b, the step C18 is followed by step C20 at which the indicator 228 is turned on to indicate that there is no stock of toner particles in the toner storage container 92b fitted to the first developing unit 56b. Subsequently to the step C19 or step C20 or when it is detected at step C17 that the indicator 224a associated with the second color select switch 224 is turned off, the subroutine program A04 reverts to the main routine program described with reference to FIG. 6 and proceeds to the subroutine program A05 thereof.

Selected Print Color Indicate Subroutine Program C04/10

Figure 9A:
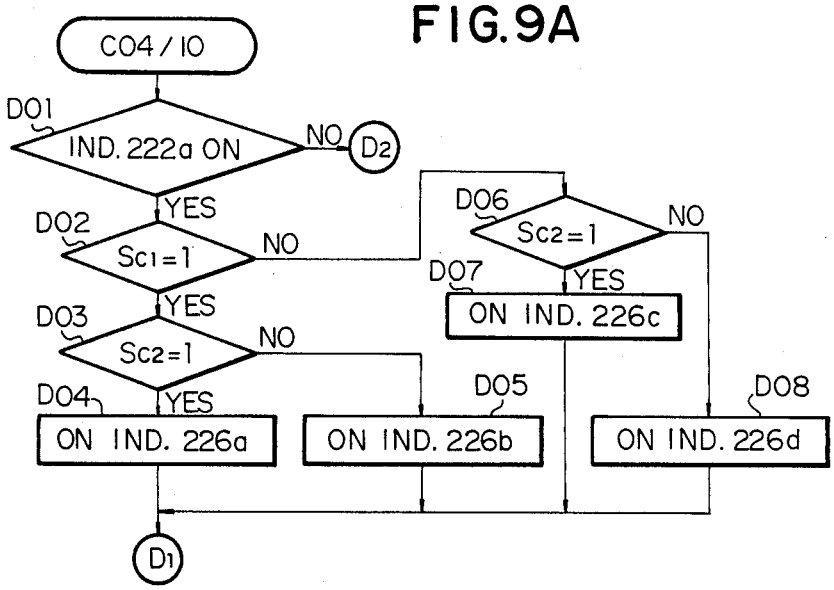
FIGS. 9A and 9B are flowcharts showing the details of the subroutine program included in the selected print color indicate routine program illustrated in FIGS. 8A and 8B.
Figure 9B:
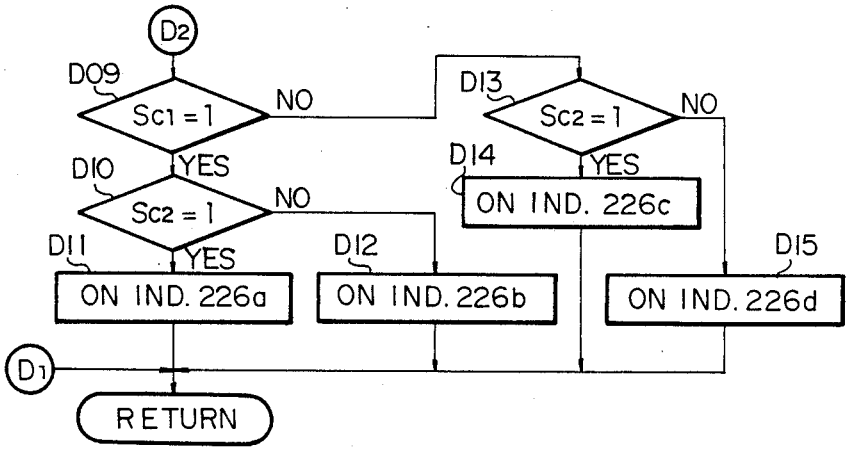

FIGS. 9A and 9B show the details of the selected print color indicate subroutine program C04/10 included in each of the first and second blocks 8/I and 8/II of the subroutine program A04 hereinbefore described with reference to FIGS. 8A and 8B.

The selected print color indicate subroutine program C04/10 includes steps which are largely broken down to two blocks of steps which consist of a first block 9/I of steps through which, when the first developing unit 56a is selected for use, the print color available by the developing unit 56a is indicated on the control panel 200, a second block of steps 9/II of steps through which, when the second developing unit 56b is selected for use, the print color available by the developing unit 56b is indicated on the control panel 200.

In the first block of steps 9/I which is shown in FIG. 9A, it is first confirmed at step D01 whether or not the indicator 222a associated with the first color select switch 222 is turned on. If the answer for this step D01 is given in the affirmative, it is tested at step D02 whether or not there is a signal $S_{C1}$ of logic "1" state from one detector switch 112a of the first color sensor 106a. If the answer for this step D02 is given in the affirmative, it is further tested at step D03 whether or not there is a signal $S_{C2}$ of logic "1" state from the other detector switch 114a of the first color sensor 106a. If the answer for this step D03 is also given in the affirmative, the step D03 is followed by step D04 at which the indicator 226a allocated to the black print color is turned on to illuminate. If the answer for the step D03 is given in the negative, the step D03 is followed by step D05 at which the indicator 226b allocated to the red print color is turned on to illuminate.

If it is determined at step D02 that there is a signal $S_{C1}$ of logic "0" state from the detector switch 112a of the first color sensor 106a, it is further tested at step D06 whether or not there is a signal $S_{C2}$ of logic "1" state from the detector switch 114a of the first color sensor 106a. If the answer for this step D06 is also given in the affirmative, the step D06 is followed by step D07 at which the indicator 226c allocated to the yellow print color is turned on to illuminate. If the answer for the step D06 is given in the negative, the step D06 is followed by step D08 at which the indicator 226*d* allocated to the blue print color is turned on to illuminate. Subsequently to any of the steps D04, D05, D07 and D08, the subroutine program C04/10 proceeds to the second block of steps 9/II shown in FIG. 9.

In the second block of steps 9/II, it is tested at step D09 whether or not there is a signal $S_{C1}$ of logic "1" state from one detector switch 112*b* of the second color sensor 106*b*. If the answer for this step D09 is given in the affirmative, it is further tested at step D10 whether or not there is a signal $S_{C2}$ of logic "1" state from the other detector switch 114*b* of the second color sensor 106*b*. If the answer for this step D10 is also given in the affirmative, the step D10 is followed by step D11 at which the indicator 226*b* allocated to the black print color is turned on to illuminate. If the answer for the step D10 is given in the negative, the step D10 is followed by step D12 at which the indicator 226*b* allocated to the red print color is turned on to illuminate.

If it is determined at step D09 that there is a signal $S_{C1}$ of logic "0" state from the detector switch 112*b* of the second color sensor 106*b*, it is further tested at step D13 whether or not there is a signal $S_{C2}$ of logic "1" state from the detector switch 114*b* of the second color sensor 106*b*. If the answer for this step D13 is also given in the affirmative, the step D13 is followed by step D14 at which the indicator 226*c* allocated to the yellow print color is turned on to illuminate. If the answer for the step D14 is given in the negative, the step D14 is followed by step D15 at which the indicator 226*d* allocated to the blue print color is turned on to illuminate.

While it has been assumed and described that the apparatus embodying the present invention is equipped with two developing units 56*a* and 56*b* in the image developing stage 56 thereof, three or more developing units may be if desired provided in an image forming apparatus according to the present invention. It may also be understood that the mechanical, optical and electrical construction and arrangement of an apparatus according to the present invention is not limited to that shown and described with reference to FIGS. 2 to 5. Thus, the present invention may be applied to an image forming apparatus of, for example, the total-area exposure type or of the type using a laser beam generator or a light-emitting diode in the image reproducing system

What is claimed is:

1. An image forming apparatus which forms a single-colored image on a photoconductive surface and transfers the single-colored image onto a transfer sheet, comprising:
   (a) latent image forming means for irradiating said photoconductive surface with information carrying light of a variable intensity for forming latent images on the photoconductive surface,
   (b) image developing means comprising at least two developing units of different types each for developing the latent images on said photoconductive surface into visible images,
   (c) selecting means for manually selecting one of said developing units,
   (d) control means for regulating the intensity of said light depending on the developing unit selected by said selecting means, and
   (e) operating means for operating said manually selected developing unit to develop said latent image.

2. An image forming apparatus as set forth in claim 1, in which said developing units use developing agents of colors which differ from one of the developing units to another in developing said latent images into said visible images and in which said control means is operative to regulate the intensity of said light depending on the color of the developing agent used in the developing unit selected by said selecting means.

3. An image forming apparatus comprising
   (a) means having a photoconductive surface,
   (b) latent image forming means for irradiating said photoconductive surface with information carrying light of a variable intensity for forming latent images on the photoconductive surface,
   (c) image developing means of any of a plurality of types and detachable from said apparatus, the image developing means being operative to develop the latent images on said photoconductive surface into visible images,
   (d) detecting means for detecting the type of said developing means attached to said apparatus, and
   (e) control means for regulating the intensity of said light depending on the type of said developing means detected by said detecting means.

4. An image forming apparatus as set forth in claim 3, in which said developing means is operative to develop said latent images into said visible images in a color prescribed for the type of said developing means and in which said control means is operative to regulate the intensity of said light depending on the color prescribed for the type of said developing means.

5. An image forming apparatus which forms a single-colored image on a photoconductive surface and transfers the single-colored image onto a transfer sheet, comprising
   (a) latent image forming means for irradiating said photoconductive surface with information carrying light of a variable intensity for forming latent images on the photoconductive surface,
   (b) image developing means comprising at least two developing units of different types each for developing the latent images on said photoconductive surface into visible images,
   (c) memory means storing a plurality of sets of data representative of different intensities, respectively, of the light with which said photoconductive surface is to be irradiated with said latent image forming means, each set of data being specific to the type of each of said developing units,
   (d) manual selecting means for manually selecting one of said developing units,
   (e) control means for regulating the intensity of said light on the basis of the set of data specific to the type of the developing unit selected by said selecting means, and
   (f) operating means for operating said manually selected developing unit to develop said latent image.

6. An image forming apparatus as set forth in claim 5, in which said developing units use developing agents of colors which differ from one of the developing units to another in developing said latent images into said visible images, each of said sets of data is specific to the color of the developing agent used in the developing unit selected by said selecting means, said control means being operative to regulate the intensity of said light on the basis of the set of data specific to the color of the developing agent used in the developing unit selected by said selecting means.

7. An image forming apparatus as set forth in claim 5, further comprising display means for indicating the intensity of light with which said photoconductive surface is to be irradiated by said latent image forming means.

8. An image forming apparatus as set forth in claim 5, further comprising means for inputting said sets of data into said memory means.

9. An image forming apparatus which forms a single-colored image on a photoconductive surface and transfers the single-colored image onto a transfer sheet, comprising (a) a document support table for supporting an original document thereon, (b) an illuminating device for irradiating said original document with light of a variable intensity, (c) a latent image forming device for projecting images on the original document irradiated on said photoconductive member to form latent images corresponding to the images projected, (d) a plurality of developing devices each of which is operative to develop said latent images into visible images, (e) a manually operable selector key for manually selecting one of said developing devices, and (f) a controller for controlling the intensity of said light depending on the developing device selected by said selector and operating said manually selected developing unit to develop said latent image.

10. An image forming apparatus as set forth in claim 1, further comprising:

(f) manual adjusting means for manually adjusting the intensity of said light.

11. An image forming apparatus as set forth in claim 10, in which said control means is operative to select one of predetermined intensities of light depending on the developing unit selected by said selecting means.

12. An image forming apparatus as set forth in claim 3, in which said image developing means comprises at least two developing units.

13. An image forming apparatus as set forth in claim 12, further comprising:

(f) manual selecting means for manually selecting one of said developing units.

14. In an image forming apparatus of the type which irradiates a photoconductive surface with information-carrying light of a variable intensity for forming latent images on the photoconductive surface, develops the latent images into single-colored images by a selected one of a plurality of developing means, and transfers the single-colored images to a transfer sheet, a method of controlling the intensity of said information-carrying light, comprising the steps of:

(a) selecting one of said plurality of developing means, (b) initially selecting one of predetermined intensities of light depending on the selected one of the developing means, (c) optionally adjusting the initially selected intensity of light, and (d) irradiating said photoconductive surface with information-carrying light of said initially selected intensity or of the optionally adjusted intensity.

15. In an image forming apparatus of the type which irradiates a photoconductive surface with information-carrying light of a variable intensity for forming latent images on the photoconductive surface, develops the latent images into single-colored images by developing means, and transfers the single-colored images to a transfer sheet, a method of controlling the intensity of said information-carrying light, comprising the steps of:

(a) attaching at least two developing means to said image forming apparatus, the developing means having different developing colors respectively assigned hereto, (b) selecting one of said developing means, (c) detecting the developing color assigned to the selected developing means, (d) initially selecting one of predetermined intensities of light depending on the detected developing color assigned to the selected one of the developing means, (e) optionally adjusting the initially selected intensity of light, and (f) irradiating said photoconductive surface with information-carrying light of said initially selected intensity or of the optionally adjusted intensity.

16. In an image forming apparatus of the type which irradiates a photoconductive surface with information-carrying light of a variable intensity for forming latent images on the photoconductive surface, develops the latent images into single-colored images by developing means, and transfers the single-colored images to a transfer sheet, a method of controlling the intensity of said information-carrying light, comprising the steps of (a) attaching one of a plurality of developing means to said image forming apparatus, the developing means having different developing colors respectively assigned thereto, (b) detecting the developing color assigned to the developing means attached to the apparatus, (c) initially selecting one of predetermined intensities of light depending on the detected developing color assigned to the selected one of the developing means, (d) optionally adjusting the initially selected intensity of light, and (e) irradiating said photoconductive surface with information-carrying light of said initially selected intensity or of the optionally adjusted intensity.

* * * * *